US007934512B2

(12) United States Patent
Spagnuolo

(10) Patent No.: US 7,934,512 B2
(45) Date of Patent: May 3, 2011

(54) HAIR HIGHLIGHTING APPLICATOR

(76) Inventor: Rose Spagnuolo, Staten Island, NY (US)

( * ) Notice: Subject to any disclaimer, the term of this patent is extended or adjusted under 35 U.S.C. 154(b) by 64 days.

(21) Appl. No.: 12/321,784

(22) Filed: Jan. 26, 2009

(65) Prior Publication Data

US 2010/0186762 A1 Jul. 29, 2010

(51) Int. Cl.
*A45D 24/22* (2006.01)
*A47L 13/30* (2006.01)
*B43M 11/06* (2006.01)

(52) U.S. Cl. ..... 132/112; 132/114; 401/261

(58) Field of Classification Search ..... 132/112, 132/113, 114, 115, 207, 208, 221; 401/23, 401/28, 136, 139, 196, 205, 261, 263; 222/92, 222/526, 527, 630–633; D28/7, 8, 63, 91.2; D4/114, 127, 137; 15/104.93, 104.94, 209.1, 15/210.1

See application file for complete search history.

(56) References Cited

U.S. PATENT DOCUMENTS

| | | | | |
|---|---|---|---|---|
| 3,477,447 | A | 11/1969 | Eldredge | |
| 3,960,160 | A * | 6/1976 | Hogan | 132/112 |
| 4,209,027 | A * | 6/1980 | Morganroth | 132/212 |
| D266,538 | S * | 10/1982 | Kahn | D28/7 |
| 4,354,512 | A | 10/1982 | Roppatte, Jr. | |
| 4,516,591 | A | 5/1985 | Hierholzer | |
| 4,813,439 | A | 3/1989 | Morgan | |
| 5,152,305 | A * | 10/1992 | Niv | 132/112 |
| 5,311,887 | A * | 5/1994 | Ramsey | 132/114 |
| 5,333,627 | A | 8/1994 | Mehringer et al. | |
| 5,339,839 | A * | 8/1994 | Forcelledo et al. | 132/114 |
| 5,499,637 | A | 3/1996 | Foti | |
| D370,783 | S * | 6/1996 | Korte | D4/114 |
| 5,524,648 | A | 6/1996 | Colon et al. | |
| 5,913,314 | A * | 6/1999 | Garrett | 132/112 |
| 5,915,390 | A * | 6/1999 | Daughtry | 132/112 |
| 5,937,865 | A * | 8/1999 | Dhaliwal | 132/114 |
| 6,062,230 | A | 5/2000 | Kajgana | |
| 6,092,535 | A | 7/2000 | Moore | |
| 6,357,449 | B1 | 3/2002 | Chu et al. | |
| 6,684,887 | B2 * | 2/2004 | Alexander | 132/112 |
| 6,691,712 | B2 * | 2/2004 | Chu et al. | 132/112 |
| 7,059,333 | B2 * | 6/2006 | Duqueroie | 132/114 |
| D602,633 | S * | 10/2009 | Spagnuolo | D28/7 |
| 7,597,106 | B2 * | 10/2009 | Desmond et al. | 132/112 |
| 2005/0139224 | A1 | 6/2005 | McNamara | |
| 2008/0060665 | A1 * | 3/2008 | Umeno et al. | 132/112 |

* cited by examiner

*Primary Examiner* — Cris L Rodriguez
*Assistant Examiner* — Vanitha Elgart
(74) *Attorney, Agent, or Firm* — Richard L. Miller

(57) ABSTRACT

A hair highlighting applicator which comprises includes a flexible dispenser for holding a hair coloring gel therein. The flexible dispenser has a first open end and a second open end. A first twist-off cap is removably mounted to the first open end of the flexible dispenser. A prong is axially supported on the first twist-off cap for separating the hair. A second twist-off cap is removably mounted to the second open end of the flexible dispenser. A mechanism is for distributing the hair coloring gel onto the hair. The distributing mechanism is axially supported on the second twist-off cap and is in fluid communication with the flexible dispenser. When the flexible dispenser is squeezed the hair coloring gel will be forced through the distributing mechanism and applied onto the hair.

1 Claim, 6 Drawing Sheets

HAIR HIGHLIGHTING APPLICATOR

BACKGROUND OF THE INVENTION

1. Field of the Invention

The present invention relates to a hair coloring tool, and more particularly, a hair highlighting applicator.

2. Description of the Prior Art

Numerous innovations for hair treatment devices have been provided in the prior art that will be described. Even though these innovations may be suitable for the specific individual purposes to which they address, however, they differ from the present invention.

A FIRST EXAMPLE, U.S. Pat. No. 3,477,447, Issued on Nov. 11, 1969, to Eldridge teaches an applicator for depositing and distributing various liquids on the scalp at the base of the hair. A screw cap, adapted for attachment to a plastic bottle, is fitted with a distributor head carrying a plurality of stiffly flexible liquid-supply nozzles. Liquid is fed to the nozzles adapted for conform at their tips to scalp contour through a manifold passage which is located in the distributor head and which communicates with the bottle through the screw cap.

A SECOND EXAMPLE, U.S. Pat. No. 4,354,512, Issued on Oct. 19, 1982, to Reppatte Jr. teaches a liquid applicator device, useful in applying bleaching or coloring compositions or the like to the hair in the course of cosmetically treating same. The device comprises a compressible container for receiving the composition; a cap closure being removably secured to the top of the container and including an opening therethrough for feeding the composition upon manual compression of the container. Brush means, including liquid distribution means, extend from the cap and are in communication with the cap opening to enable feed of the composition to the brush. A hair-parting wand extends from the cap at an angle diverging from the direction of extension of the brush, whereby a user of the device may employ the wand to part and separate the hair and thereupon utilize the brush to apply the treating composition.

A THIRD EXAMPLE, U.S. Pat. No. 4,516,591, Issued on May 14, 1985, to Hierholzer teaches an applicator that applies a hair treating material to the surface of less than all of an individual's hair. The applicator comprises a material supply container and a dispenser including a comb structure having a plurality of teeth pairs in which some of the pairs have shallow roots therebetween and some have deep roots. In a preferred embodiment of the invention, passages are provided in the dispensing comb structure to deliver the treating material through at least some of the shallow roots in order to apply the material to less than all of the hair of the individual.

A FOURTH EXAMPLE, U.S. Pat. No. 4,813,439, Issued on Mar. 21, 1989, to Morgan teaches a hair treatment solution applicator adapted to be attached to the mouth of a squeeze bottle containing the hair treatment solution by an attachment element having a dispensing valve therein. An applicator portion, in the form of a substantially flat or planar element lying in the plane of the squeeze bottle axis, is secured to the attachment element and is provided with a comb-like distributor element at its side remote from the attachment element. The planar applicator element is provided with a slot at the side which includes the distributor element which communicates with the dispensing valve. Substantially adjacent the comb-like distributor element, there is arranged an elongated spike-like, hair-sectioning pick extending perpendicular to the axis of the squeeze bottle in the plane defined by the applicator portion.

A FIFTH EXAMPLE, U.S. Pat. No. 5,152,305, Issued on Oct. 6, 1992, to Niv teaches an apparatus for a hair dye applicator which includes a hollow tubular housing with screw-threadably removable caps on both longitudinal ends thereof. One of the caps includes a centrally located outlet through which a hollow stem of an integrally formed nozzle unit is fitted. A manually actuable piston is provided within the tubular housing and includes an actuator member longitudinally slidable along the length of and external to the tubular housing. To ensure that the piston does not axially rotate within the tubular housing during a longitudinal sliding motion thereof, a protruding track is longitudinally provided on the inner wall of the tubular housing and mates with a corresponding recess of the piston. A liner such as a disposable plastic bag is provided within the tubular housing above the piston for receiving a hair dispensable product therein. The screw-threaded end caps confine the contents of the applicator during use thereof.

A SIXTH EXAMPLE, U.S. Pat. No. 5,333,627, Issued on Aug. 2, 1994, to Mehringer et al. teaches a container that contains fluid to be applied to human hair. A plunger is movably mounted in the container and moves the fluid towards a dispenser end of the housing. An expulsion base is mounted on the dispenser end of the housing. This expulsion base defines a plurality of container channels. A removable dispenser head is mounted on the expulsion base and the dispenser then defines a plurality of head channels. These head channels are substantially aligned with the container channels at one end of the dispenser head. The head channels are distributed along another end of the dispenser head. A spreading device is positioned at the another end of the dispenser head and receives fluid from the dispenser head and spreads out the fluid on the hair.

A SEVENTH EXAMPLE, U.S. Pat. No. 5,499,637, Issued on Mar. 19, 1996, to Foti teaches an improved applicator brush that provides a tapered handle portion for lifting and separating hair, and a plurality of bristles emanating perpendicularly therefrom. In one embodiment, the brush is formed by connecting a conventional applicator brush through a bore in a tapered handle in order to form the perpendicular connection.

AN EIGHTH EXAMPLE, U.S. Pat. No. 5,524,648, Issued on Jun. 11, 1996, to Colon et al. teaches a combined brush and comb ("brush-comb") which is used to apply tones, touches or streaks of hair treatment liquid to human hair. The brush-comb has a curved body portion terminating in a tip, which may be used to part the hair, and a head portion having comb tines and brush tufts positioned close to the tines. Each tine has at least one and preferably a plurality of grooves perpendicular to its axis to retain the liquid and to replenish the liquid to the brush tufts. In operation, the brush-comb head portion is dipped into a container of the liquid and then the head portion is pulled through the hair to apply touches of the liquid to selected areas of the hair.

A NINTH EXAMPLE, U.S. Pat. No. 6,062,230, Issued on May 16, 2000, to Kajgana teaches a tint brush with a color distributor having an anatomically designed container which has an elliptical shape and is screwed onto a connection pipe with a main tinter body. The container and connection pipe are inclined relative to a vertical axis of the main tinter body, preferably, by 60 degrees. A free flow of hair dye mixture from the container is enabled by squeezing the container or by using a pump provided in the container in an alternative embodiment. A collector area defined in the main tinter body collects dye mixture wherefrom the dye mixture is distributed with the aid of a flow regulator and a plurality of radial exit bores which define, on their ends, funnel-like or shaped openings that open in tangent with a set of bristles connected to the tinter body. The flow regulator is suitably grooved so that the rate of dye mixture flowing through the main tinter body can be regulated from a minimum to a maximum amount by turning the flow regulator by 90 degrees. The flow regulator body is sealed to the main tinter body using a set of O-rings and the grooves defined in the regulator body are formed adjacent the plurality of radial exit bores so that the dye mixture flow can be controlled.

A TENTH EXAMPLE, U.S. Pat. No. 6,092,535, Issued on Jul. 25, 2000, to Moore teaches a multi-purpose hair coloring tool that includes an elongated body and a plurality of bristles projecting from the body adjacent one end thereof. The bristles cooperatively define a serrated brush edge spaced from the body, with the brush edge being particularly effective in applying coloring agents to the hair. Adjacent the opposite end of the body is a hook which may be used for such techniques as cap highlighting or hair weaving.

AN ELEVENTH EXAMPLE, U.S. Pat. No. 6,357,449, Issued on Mar. 19, 2002, to Chu et al. teaches a dispensing device for use as a hair dye applicator having a manifold having a first end configured to receive liquid dye and an inside surface and an outside surface. The manifold has a conduit communicating with the inside surface and the first end which provides fluid communication between the first end and at least one orifice extending from the inside surface to the outside surface. The manifold further includes a first lip and a second lip on the outside surface with the first lip surrounding the orifice and the second lip surrounding the first lip. The manifold further includes a flexible fluid dispensing member having an inside surface and an outside surface and a plurality of apertures passing from the inside surface to the outside surface that presents the dye to the hair, the inside surface of the member contacting the outside surface of the manifold including the first and second lips such that a resilient seal is formed until the dye is forced through the orifices when the member allows the dye to pass over the first lip and through the plurality of apertures.

A TWELFTH EXAMPLE, U.S. Patent Office Publication No. 2005/0139224, Published on Jun. 30, 2005, to McNamara teaches a hair coloring tool that is particularly effective and efficient in performing foil highlighting and hair coloring. The hair coloring tool is used to separate and foil hair tufts and then apply hair coloring agents to the hair tufts. An advantageous embodiment of the hair coloring tool comprises an elongate body having a first end and a second end. The first end comprises a thin metal rod and the second end comprises a plurality of bristles attached to the second end of the body. The first end of the tool is used to perform foil highlighting and the second end of the tool is used to perform hair coloring. A gripping handle between the first end and the second end facilitates the rotation of the hair coloring tool as the user alternately uses each end of the hair coloring tool.

It is apparent now that numerous innovations for hair treatment devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a hair highlighting applicator that avoids the disadvantages of the prior art.

ANOTHER OBJECT of the present invention is to provide a hair highlighting applicator that is simple and inexpensive to manufacture.

STILL ANOTHER OBJECT of the present invention is to provide a hair highlighting applicator that is simple to use.

BRIEFLY STATED, STILL YET ANOTHER OBJECT of the present invention is to provide a hair highlighting applicator which comprises a flexible dispenser for holding a hair coloring gel therein. The flexible dispenser has a first open end and a second open end. A first twist-off cap is removably mounted to the first open end of the flexible dispenser. A prong is axially supported on the first twist-off cap for separating the hair. A second twist-off cap is removably mounted to the second open end of the flexible dispenser. A mechanism is for distributing the hair coloring gel onto the hair. The distributing mechanism is axially supported on the second twist-off cap and is in fluid communication with the flexible dispenser. When the flexible dispenser is squeezed the hair coloring gel will be forced through the distributing mechanism and applied onto the hair.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWING

The figures of the drawings are briefly described as follows.

A MARSHALING OF REFERENCE NUMERALS UTILIZED IN THE DRAWING

Figure 1:
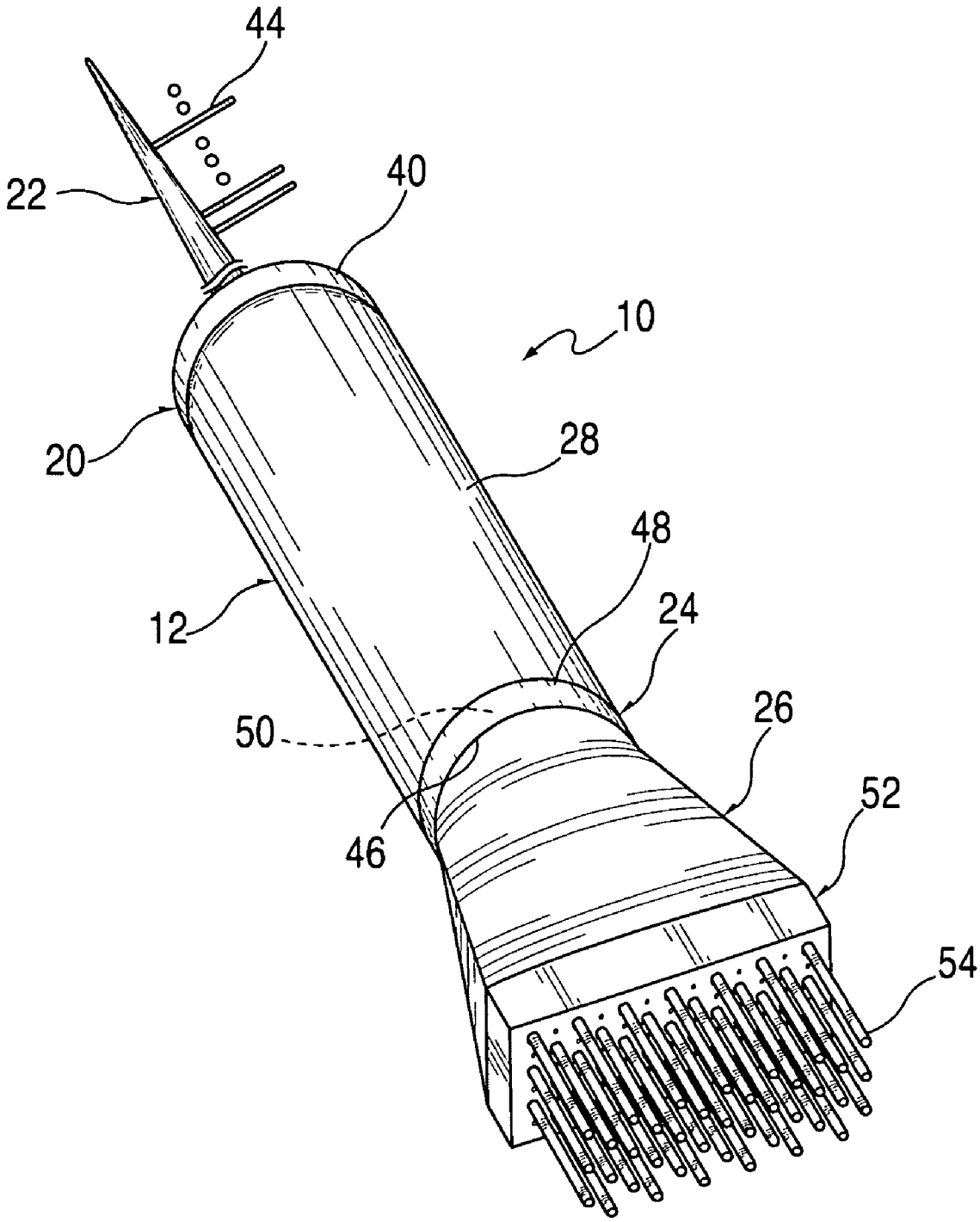
FIG. 1 is a diagrammatic perspective view of a first embodiment of the present invention.

10 first embodiment of hair highlighting applicator
12 flexible dispenser of applicator 10
14 hair coloring gel
16 first open end of flexible dispenser 12
18 second open end of flexible dispenser 12
20 first twist-off cap of applicator 10
22 prong of applicator 10
24 second twist-off cap of applicator 10
26 first embodiment of distributing mechanism of applicator 10
28 hollow plastic tubular member for flexible dispenser 12

30 external threads on first open end 16
32 external threads on second open end 18
34 top cover portion of first twist-off cap 20
36 central internal threaded recess in top cover portion 34
38 air intake check valve in top cover portion 34
40 annular collar of first twist-off cap 20
41 internal threads in annular collar 40
42 externally threaded hub of prong 22
44 tooth on prong 22
46 bottom cover portion of second twist-off cap 24
48 annular collar of second twist-off cap 24
50 internal threads in annular collar 48
52 manifold member for distributing mechanism 26
54 hollow bristle of manifold member 52
56 central internal threaded aperture in bottom cover portion 46
58 inverted T-shaped manifold member for distributing mechanism 26
60 hollow shank of inverted T-shaped manifold member 58
62 external threaded end of hollow shank 60
64 hollow bristle of inverted T-shaped manifold member 58
66 internal threads in external threaded end 62
110 second embodiment of hair highlighting applicator
126 second embodiment of distributing mechanism of hair highlighting applicator 110

DETAILED DESCRIPTION OF THE PREFERRED EMBODIMENT

Figure 2:
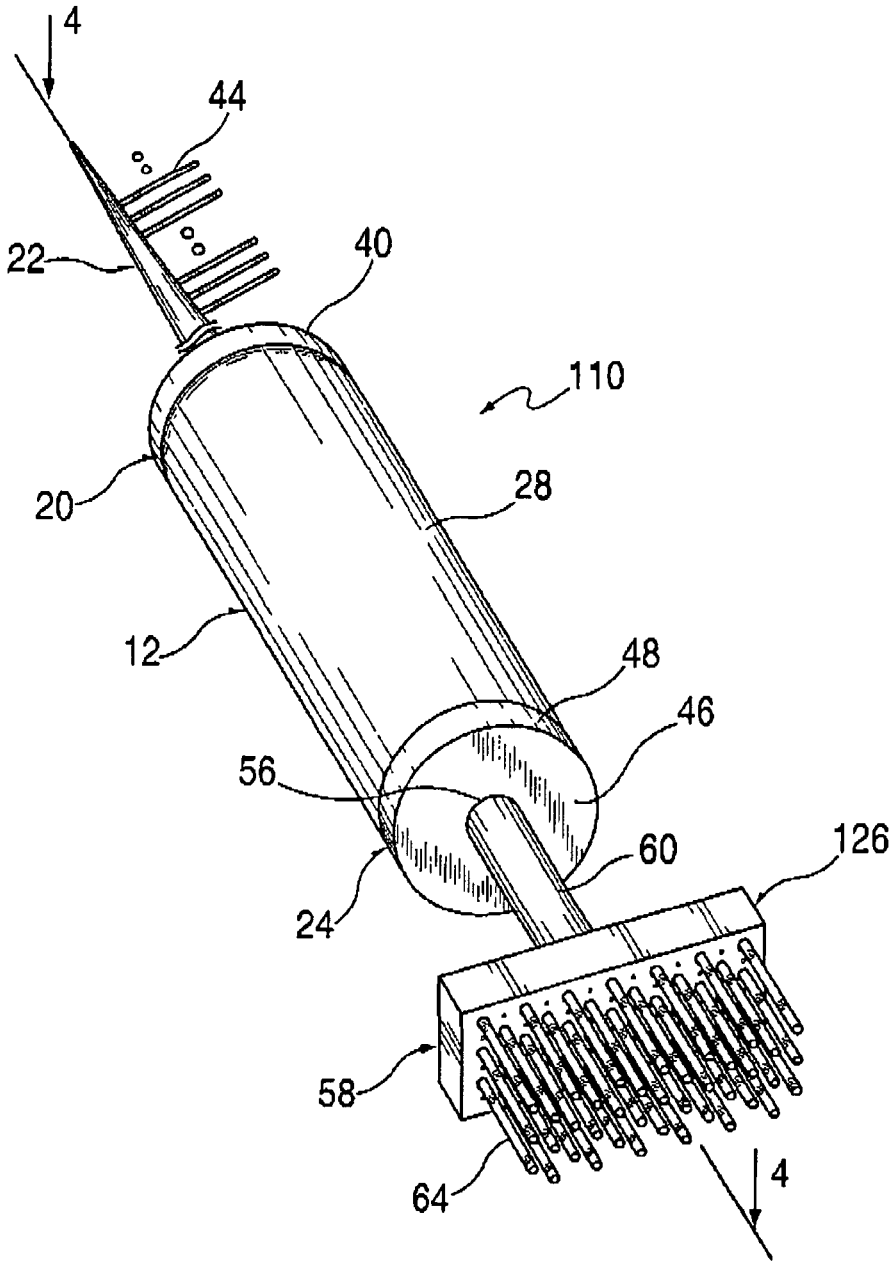
FIG. 2 is a diagrammatic perspective view of a second embodiment of the present invention.
Figure 3:
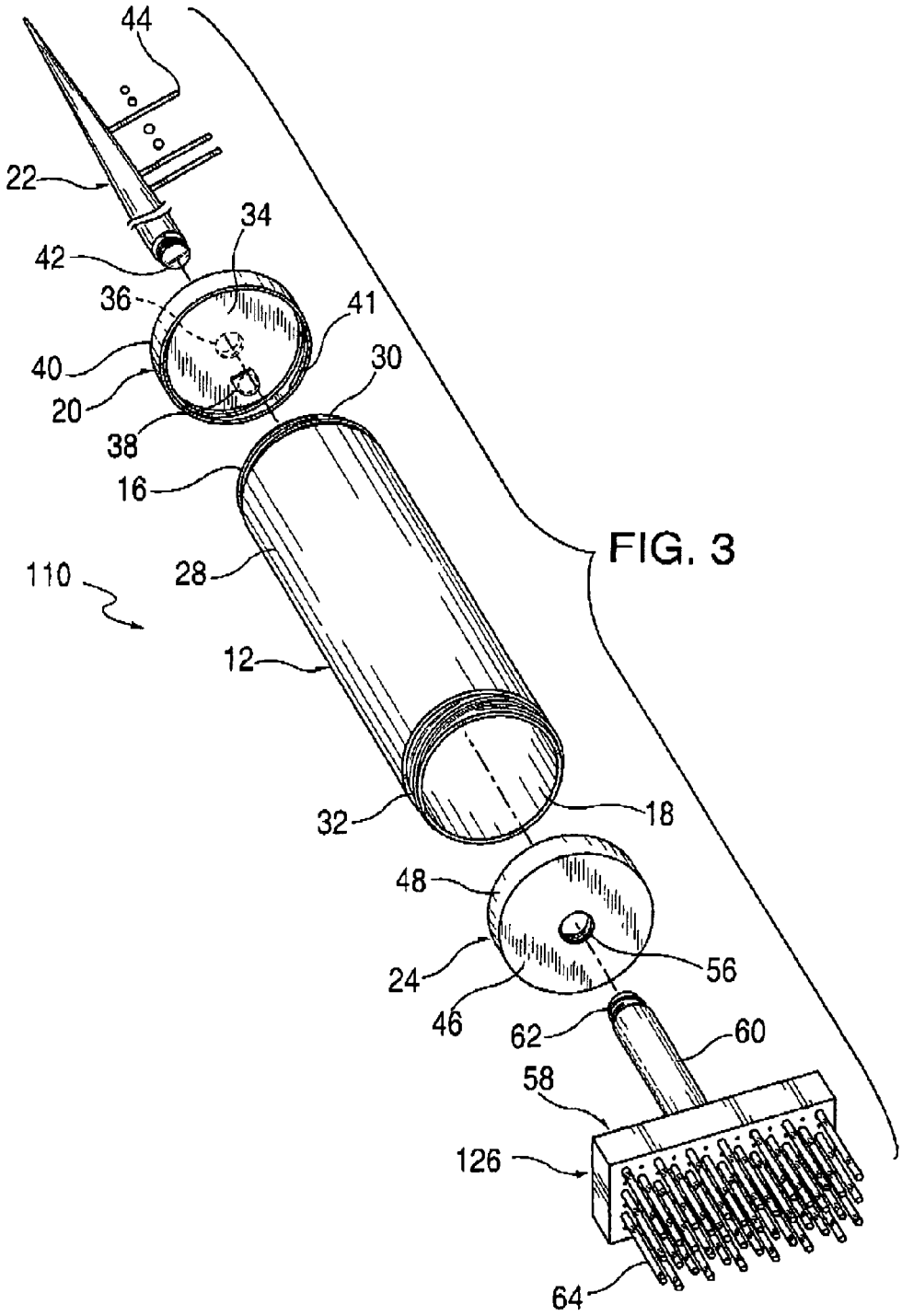
FIG. 3 is a diagrammatic exploded perspective view of the second embodiment.
Figure 4:
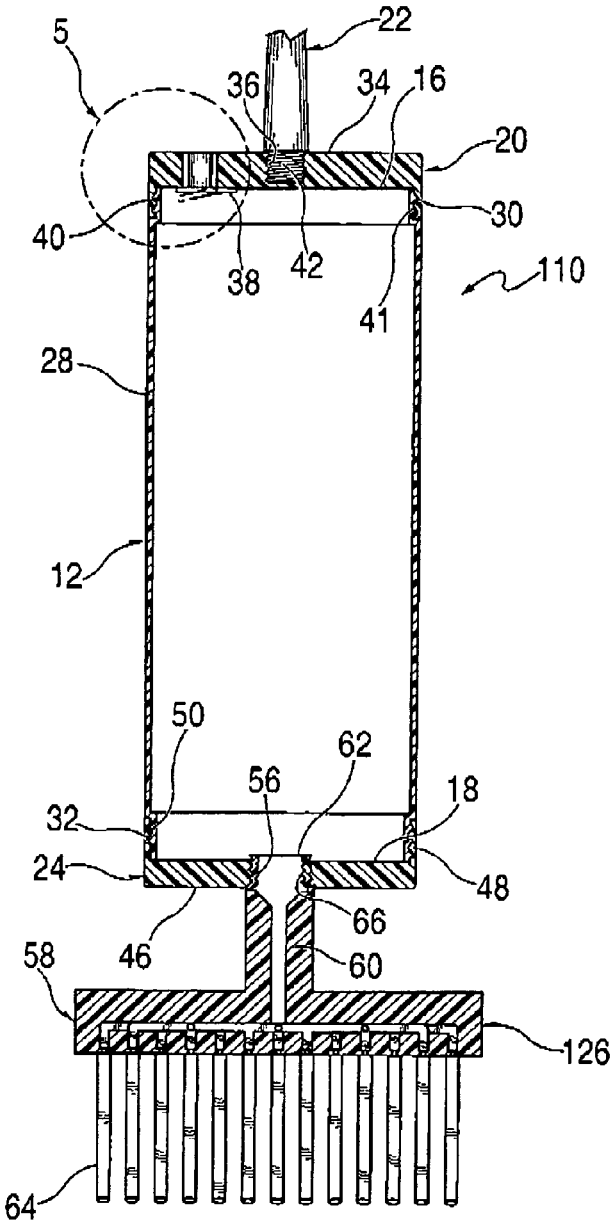
FIG. 4 is a diagrammatic cross-sectional view taken on line 4-4 in FIG. 2, with parts broken away.
Figure 5:
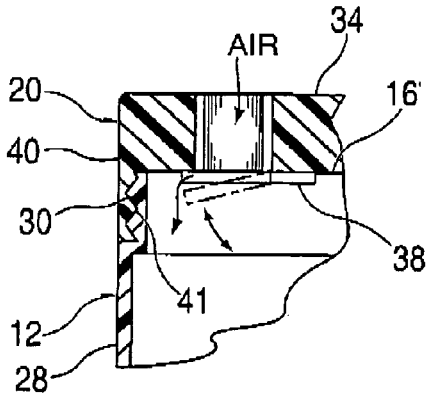
FIG. 5 is an enlarged diagrammatic cross-sectional view of the area enclosed in the dotted circle indicated by arrow 5 in FIG. 4, showing the air intake check valve in greater detail.
Figure 6:
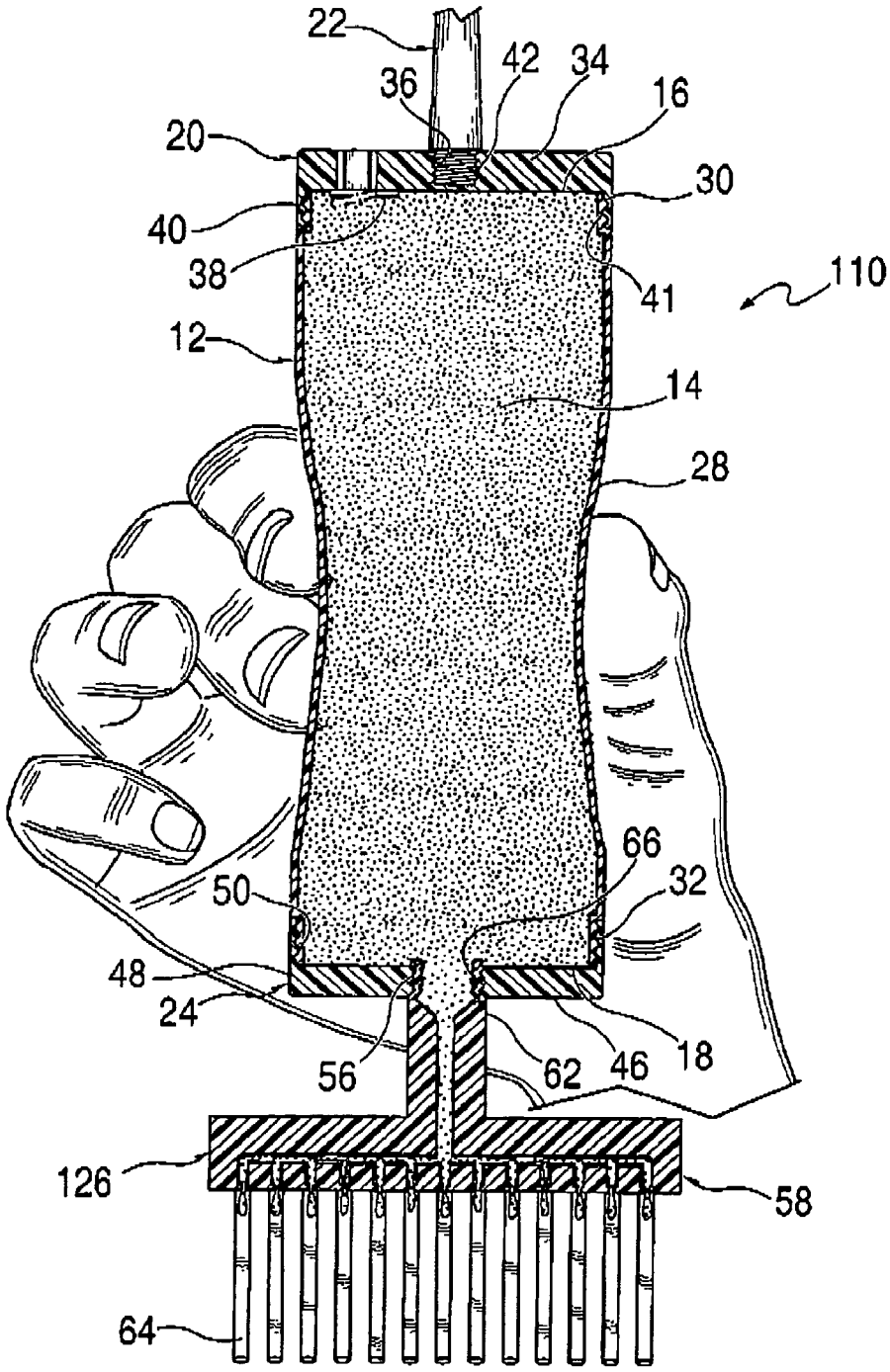
FIG. 6 is a diagrammatic cross-sectional view similar to FIG. 5, showing hair coloring gel being squeezed into the distributor mechanism.
Figure 7:
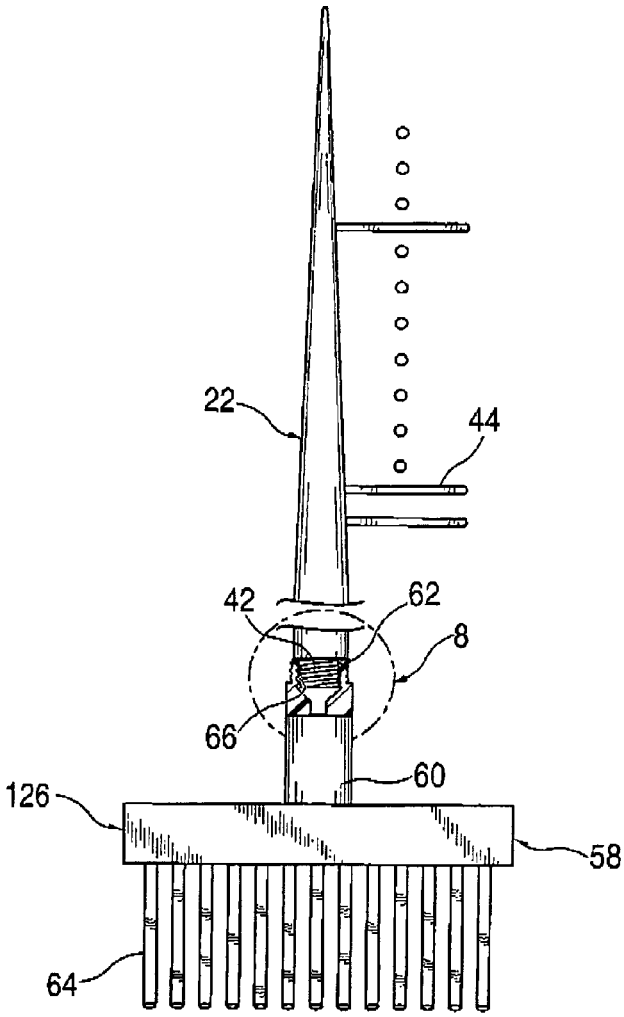
FIG. 7 is a diagrammatic elevational view partly in cross section showing the prong and the distributor mechanism removed and attached to each other.

Referring now to the figures, in which like numerals indicate like parts, and particularly to FIGS. 1 through 8, which are a diagrammatic perspective view of a first embodiment of the present invention; a diagrammatic perspective view of a second embodiment of the present invention; a diagrammatic exploded perspective view of the second embodiment; a diagrammatic cross-sectional view taken on line 4-4 in FIG. 2, with parts broken away; an enlarged diagrammatic cross-sectional view of the area enclosed in the dotted circle indicated by arrow 5 in FIG. 4, showing the air intake check valve in greater detail; a diagrammatic cross-sectional view similar to FIG. 5, showing hair coloring gel being squeezed into the distributor mechanism; a diagrammatic elevational view partly in cross section showing the prong and the distributor mechanism removed and attached to each other; and an enlarged diagrammatic elevational view of the area enclosed in the dotted circle indicated by arrow 8 in FIG. 7, and as such, will be discussed with reference thereto.

The present invention is a hair highlighting applicator 10 which comprises a flexible dispenser 12 for holding a hair coloring gel 14 therein. The flexible dispenser 12 has a first open end 16 and a second open end 18. The first twist-off cap 20 removably mounted to the first open end 16 of the flexible dispenser 12. A prong 22 is axially supported on the first twist-off cap 20 for separating the hair. A second twist-off cap 24 is removably mounted to the second open end 18 of the flexible dispenser 12. A mechanism 26 is for distributing the hair coloring gel 14 onto the hair. The distributing mechanism 26 is axially supported on the second twist-off cap 24 and is in fluid communication with the flexible dispenser 12. When the flexible dispenser 12 is squeezed, as shown in FIG. 6, the hair coloring gel 14 will be forced through the distributing mechanism 26 and applied onto the hair.

The flexible dispenser 12 comprises a hollow plastic tubular member 28 having external threads 30 on the first open end 16 and external threads 32 on the second open end 18. The first twist-off cap 20 comprises a top cover portion 34 having a central internal threaded recess 36 therein, an air intake check valve 38 therethrough and an annular collar 40 having internal threads 41 to engage with the external threads 30 on the first open end 16 of the hollow plastic tubular member 28.

The prong 22 comprises an externally threaded hub 42 to engage with the central internal threaded recess 36 in the top cover portion 34 of the first twist-off cap 20. The prong 22 further comprises a plurality of teeth 44 extending transversely and spaced apart therefrom to form a comb for combing the hair.

In FIG. 1, the second twist-off cap 24 comprises a bottom cover portion 46 and an annular collar 48 having internal threads 50 to engage with the external threads 32 on the second open end 18 of the hollow plastic tubular member 28. The distributing mechanism 26 comprises a manifold member 52 having a plurality of hollow bristles 54 depending therefrom to carry the hair coloring gel 14 onto the hair.

In FIGS. 2, 3, 4 and 6 the second twist-off cap 24 of the second embodiment of the hair highlighting applicator 110 comprises a bottom cover portion 46 having a central internal threaded aperture 56 therethrough, and an annular collar 48 having internal threads 50 to engage with the external threads 32 on the second open end 18 of the hollow plastic tubular member 28. The distributing mechanism 126 comprises an inverted T-shaped manifold member 58 having a hollow shank 60 with an external threaded end 62 to engage with the central internal threaded aperture 56 in the bottom cover portion 46 of the second twist-off cap 24. The inverted T-shaped manifold member 58 has a plurality of hollow bristles 64 depending therefrom to carry the hair coloring gel 14 onto the hair.

Figure 8:
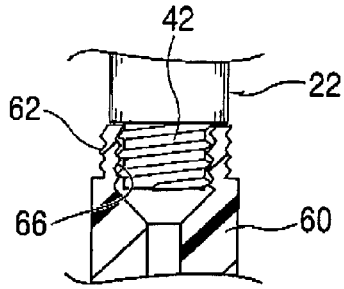
FIG. 8 is an enlarged diagrammatic elevational view of the area enclosed in the dotted circle indicated by arrow 8 in FIG. 7.

The external threaded end 62 of the hollow shank 60 of the inverted T-shaped manifold member 58, further comprises internal threads 66 therein to selectively engage directly with the externally threaded hub of the prong 22, as shown in FIGS. 7 and 8. This allows a person to selectively use the prong 22 with the teeth 44 as a comb and the inverted T-shaped manifold member 58 as a brush, without a need for the flexible dispenser 12.

It will be understood that each of the elements described above, or two or more together, may also find a useful application in other types of constructions differing from the types described above.

While the invention has been illustrated and described as embodiments of a hair highlighting applicator, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hair highlighting applicator which comprises:

a) a flexible dispenser for holding a hair coloring gel therein, said flexible dispenser having a first open end and a second open end;

b) a first twist-off cap removably mounted to said first open end of said flexible dispenser;

c) a prong axially supported on said first twist-off cap for separating the hair;

d) a second twist-off cap removably mounted to said second open end of said flexible dispenser; and e) means for distributing the hair coloring gel onto the hair, said distributing means axially supported on said second twist-off cap and in fluid communication with said flexible dispenser, wherein when said flexible dispenser is squeezed the hair coloring gel will be forced through said distributing means and applied onto the hair;

wherein said flexible dispenser comprises a hollow plastic tubular member having external threads on said first open end and external threads on said second open end;

wherein said first twist-off cap comprises a top cover portion having a central internal threaded recess therein, an air intake check valve therethrough and an annular collar having internal threads to engage with said external threads on said first open end of said hollow plastic tubular member;

wherein said prong comprises an externally threaded hub to selectively engage with said central internal threaded recess in said top cover portion of said first twist-off cap so as to allow a person to selectively use said prong as a hair separator;

wherein said prong further comprises a plurality of teeth extending transversely and spaced apart therefrom to form a comb for combing the hair;

wherein said second twist-off cap comprises a bottom cover portion having a central internal threaded aperture therethrough and an annular collar having internal threads to engage with said external threads on said second open end of said hollow plastic tubular member;

wherein said distributing means comprises an inverted T-shaped manifold member having a hollow shank with an external threaded end to engage with said central internal threaded aperture in said bottom cover portion of said second twist-off cap, said inverted T-shaped manifold member having a plurality of hollow bristles depending therefrom to carry the hair coloring gel onto the hair; and wherein said external threaded end of said hollow shank of said inverted T-shaped manifold member further comprises internal threads therein to selectively engage directly with said externally threaded hub of said prong so as to allow a person to selectively use said prong with said teeth as a comb and said inverted T-shaped manifold member as a brush, without a need for said flexible dispenser.

* * * * *